US005469179A

United States Patent [19]

Kikuchi

[11] Patent Number: 5,469,179

[45] Date of Patent: Nov. 21, 1995

[54] PARAMETRICALLY AMPLIFYING TRAVELING-WAVE ANTENNA

[76] Inventor: Horishi Kikuchi, 3-8-18, Komagome, Toshima-ku, Tokyo 170, Japan

[21] Appl. No.: 223,534

[22] Filed: Apr. 5, 1994

[30] Foreign Application Priority Data

Apr. 6, 1993 [JP] Japan ..... 5-079534

[51] Int. Cl.[6] ..... H01Q 11/02

[52] U.S. Cl. ..... 343/731; 343/749; 343/846; 343/853

[58] Field of Search ..... 343/700 MS File, 343/731, 739, 749, 705, 708, 853

[56] References Cited

U.S. PATENT DOCUMENTS

| | | | |
|---|---|---|---|
| 1,602,085 | 10/1926 | Rice et al. | 343/731 |
| 2,095,078 | 10/1937 | Petterson | 343/731 |
| 3,806,946 | 4/1974 | Tiuri et al. | 343/731 |
| 4,021,810 | 5/1977 | Urpo et al. | 343/731 |
| 4,529,988 | 7/1985 | Tames et al. | 343/731 |

OTHER PUBLICATIONS

"Traveling Wave and Broadband Antennas", IEEE Trans. Antennas and Propag., vol. AP-22, No. 1, Jan. 1974, pp. 372–274.

"Radio Antenna Engineering", Laport, McGraw-Hill, 1952 pp. 55–60.

Harold H. Beverage et al., "The Wave Antenna" AIEE, New York, N.Y., Feb. 14–17, 1923.

Hiroshi Kikuchi, "Active Distributed Parameter Lines With Ground Return", Nihon University, College of Science and Technology, Tokyo, Japan, pp. 153–161.

H. Kikuchi. "Wave Propagation Along Infinite Wire Above Ground at High Frequencies", Electrotechnical Journal of Japan, vol. 2, No. 3/4, pp. 73–78, Dec. 1956.

H. Kikuchi. "Propagation Coefficient of the Beverage Aerial", Proc. IEE, vol. 120, No., 6, Jun. 1973, pp. 637–638.

H. Kikuchi. "Power Line Transmission and Radiation", Space Science Reviews, 35, 1983, pp. 59–80.

*Primary Examiner*—Donald T. Hajec
*Assistant Examiner*—Tan Ho
*Attorney, Agent, or Firm*—Leydig, Voit & Mayer

[57] ABSTRACT

A parametrically amplifying traveling-wave antenna utilizing parametric amplification by strong coupling or resonance between an induced wave and an incident sky wave, the antenna including a base-plate or ground having electrical constants satisfying the resonance condition and a conducting wire or array installed above the base-plate or ground. Both ends of the wire are terminated by a surge impedance to prevent reflections.

11 Claims, 6 Drawing Sheets

PARAMETRICALLY AMPLIFYING TRAVELING-WAVE ANTENNA

BACKGROUND OF THE INVENTION

1. Field of the Invention

This invention relates to a horizontal type of traveling-wave antenna with the construction of a line- or strip-conductor or a horizontal array above a ground.

2. Description of the Related Art

There are two types of horizontal antennas such as the microstrip and the wave (Beverage) in antenna similar in construction to the present invention. For ground return, the microstrip uses a metallic base, while the wave antenna utilizes the natural earth with a finite conductivity. The conventional micro-strip antenna, however, is quite different in principle and operation from the wave antenna and the present one due to the different effects arising from high and low conductivity of the ground return. Therefore, this invention relates rather to the wave antenna in the sense that a traveling wave induced in the wire is further coupled to an incident sky wave.

FIG. 6 shows a schematic view of the wave antenna as described in an article entitled "The Wave Antenna—A New Type of Highly Directive Antenna" by H. H. Beverage, C. W. Rice, and E. W. Kellogg, which was published in a periodical, A.I.E.E., Vol. 42. Feb., 1923, pp. 215–266 [Ref. 1], where 9 is a conducting wire of the order of one wavelength long and several to ten meters above the earth and is installed within the plane of wave incidence, 10 is the earth return, 3 is the input end on the transmitter side, 4 is the receiver end, and 5 is a receiving set. When the signal wave reaches the antenna, an electromotive force is induced in the horizontal wire. A small current thus induced in each element of the wire starts to flow toward the receiver end, where the total current cumulated by successive additions is led to the receiver 5. Thus, the wave antenna utilizes the fact that the amplitude of the induced current becomes a maximum at a point on the wire 9.

The conventional wave antenna mentioned above has so far been used for long-wave communications in the range below 100 KHz in frequency or above 3 Km in wavelength, and the velocity of the induced wave on the wire, i.e., a line wave, is somewhat less than the velocity of light (slow wave), while the front velocity of the incident sky wave along the wire is higher than the velocity of light (fast wave) for an oblique incidence, and is equal to the velocity of light for horizontal incidence. Due to this difference in velocity between the line and sky waves, interference effects develop, the induced current on the wire building up at first for a certain distance and then decreasing in amplitude, as illustrated by the dashed line b in FIG. 3. (see also FIG. 2 at page 216 in Ref.1) This is because a phase difference between the incident sky wave and the induced line wave along the wire 9 caused by the difference in velocities acts to reduce the line current. In other words, the induced line wave couples only weakly to the sky wave for horizontal or near horizontal incidence. Thus, the amplification of the induced line current element itself does not occur for the conventional wave antenna, its attenuation constant still being equal to that of the eigen-wave of the line, $\alpha_0$ (>0) (damping wave). Consequently, the gain for the conventional wave antenna remains rather small.

SUMMARY OF THE INVENTION

This invention is intended to solve these problems and utilizes a new effect of parametric amplification of the induced line wave by the incident sky wave due to strong coupling or resonance between both waves. This is achieved by making the phase velocity of the induced wave nearly equal to the front velocity of the sky wave along the wire under the following conditions. The material of ground is a semiconductor or a lossy dielectric whose medium constants (conductivity, dielectric constant, and permeability) are such that the resonance condition, $Q'-Q>\delta c/4a$ is satisfied, where Q and Q' are extended Carson's functions arising from a finite conductivity of the ground as explicitly defined later, $\delta c$ the skin depth of wire, and a is the wire radius. Both ends of wire are lumped together and terminated by the surge impedance to the ground. Then, the line current induced by the sky wave grows for a certain resonance angle near grazing incidence, gaining energy from the sky wave. Thus, the line current receives a parametric amplification as a result of its strong coupling or resonance with the sky wave as it travels along the wire, and becomes maximum at the receiving end. A distinction in terminology between 'semiconductor' and 'glossy dielectric' used hereafter is, in a semiconductor, the displacement current is roughly comparable to the conduction current ($\sigma \gtrsim \omega\epsilon$), while in a lossy dielectric, the displacement current is much higher than the conduction current ($\sigma<\omega\epsilon$).

To this end, the present invention provides a parametrically amplifying traveling-wave antenna with remarkably high gain and directivity for wave reception over a broad area of applications.

DESCRIPTION OF THE PREFERRED EMBODIMENTS

Embodiments of the present invention will be described below with reference to the accompanying drawings.

Figure 1:
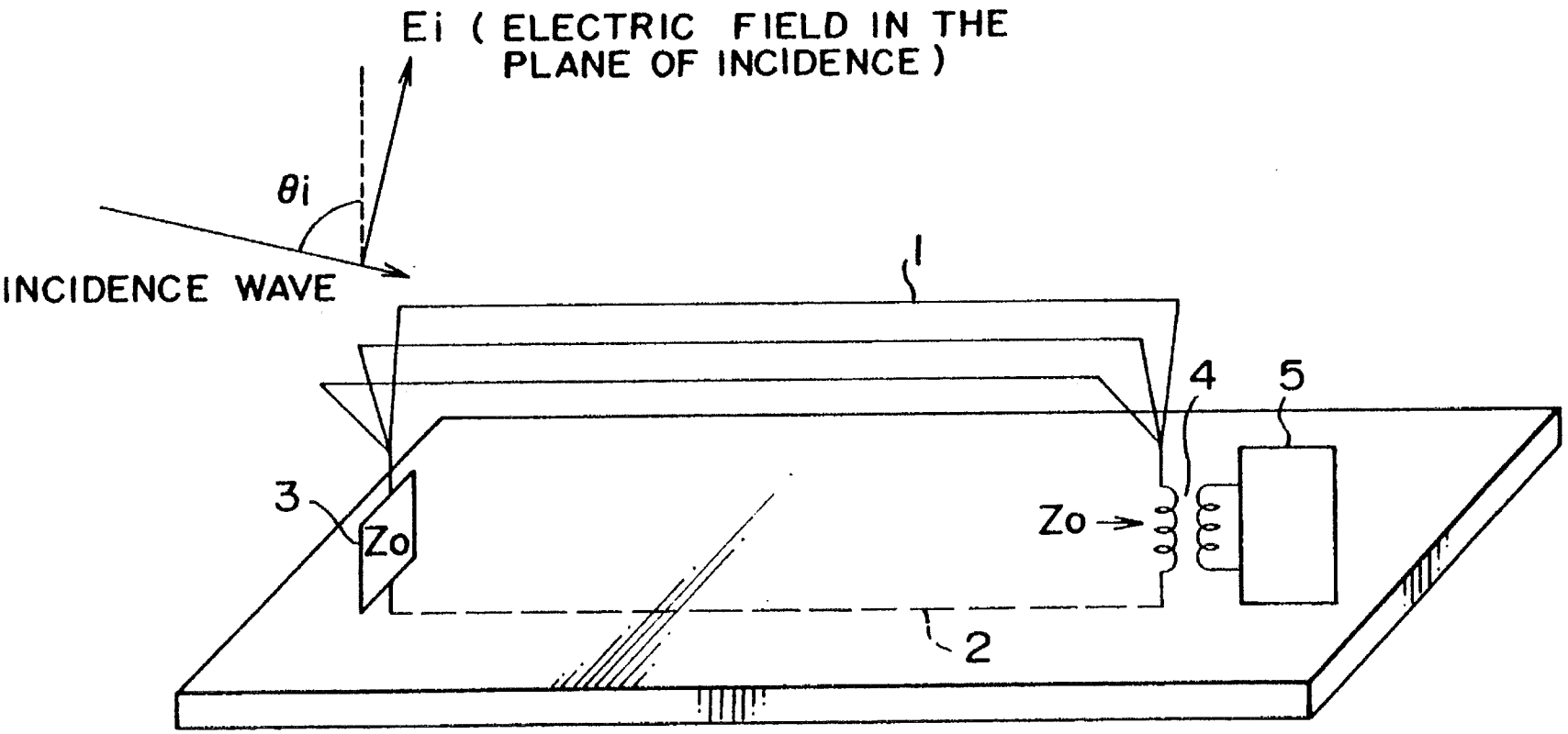
FIG. 1 is a schematic diagram of the construction of a parametrically amplifying traveling-wave antenna based on an embodiment of the present invention.

Referring to FIG. 1, a parametrically amplifying traveling-wave antenna has a conducting wire or an array of wires 1 including several (3~7) wires above a base-plate 2 that constitutes a current return for above wire(s). The length l of each wire is such that $\alpha_0 l<1$ ($\alpha_0$: attenuation constant of the eigen-wave), $\beta_0 l>1$ or $l>\lambda$ ($\lambda$: wavelength of the sky wave), and each wire is installed about one wavelength or less above the base-plate or ground at equal intervals less than the order of one-half wavelength. Both ends 3 and 4 of wire are, respectively, lumped together and terminated by the surge impedance $Z_0$ to the base-plate. The receiver end 4 is connected to a receiving set 5.

The wire is copper, and the radius a and height h of wire naturally decrease with increasing frequency f, although the former is less critical, for example, a=2.5~0.5 mm and h=7.5 m~1 cm for f=5 MHz~50 GHz for an air environment. Accordingly, the surge impedance is determined by those dimensions and the electrical properties of the ground, and consists of a resistive and a small reactive component. The size of the base-plate 2 is somewhat longer than the wire(s), being of the order of one wavelength wide for a single wire, by one wavelength or so wider than the array width for multiple wires, and of the order of a skin depth or less thick.

The base-plate is made of a semiconductor or a lossy dielectric whose conductivity and dielectric constant are determined in such a way as to satisfy the following relation, depending upon a range of frequencies used, $$Q' - Q - \frac{\delta_c}{4a} > 0$$

$$Q = Re\frac{1}{k_2^2 - k_1^2}\int_0^\infty \{u - \sqrt{u^2 - (k_2^2 - k_1^2)}\}\, e^{-(2h-a)u} du$$

$$Q' = Re\int_0^\infty \frac{e^{-(2h-a)u}}{\eta u + \sqrt{u^2 - (k_2^2 - k_1^2)}}\, du$$

$$k_1^2 = \omega^2\epsilon_1\mu_1,\ k_2^2 = \omega^2\epsilon_2\mu_2 - j\omega\sigma_2\mu_2,\ \mu_1 = \mu_2 = \mu_0$$

$$\eta = k_2^2/k_1^2 \qquad \delta_c = \sqrt{2/(\omega\sigma_c\mu_c)}$$

where Re stands for the real part, k is the wave number, $\sigma$, $\epsilon$, and $\mu$ are the conductivity, dielectric constant, and permeability, $\omega=2\pi f$ is the angular frequency, h is the height of wire(s), a is the wire radius, $\delta c$ is the skin depth, and the subscripts c, 1, and 2 refer to the wire conductor, medium 1 (dielectric environment), and medium 2 (base-plate or ground), respectively. Q and Q' are extended Carson's functions including corrections arising from finite earth conductivity and permitivity for series impedance and parallel admittance, and u is an integral variable in a Fourier representation of the functions as described in "Power Line Radiation Transmission and Radiation", Reference 5*e*, written by the inventor, identified further below.

As the sky wave travels along the antenna at an angle of near grazing incidence, it induces an electromotive force successively in different portions of the line, producing forward and backward currents along the wire. The forward current starts to run down, following right along with the tilted front of the sky wave, and grows, gaining energy from the sky wave, as it travels toward the receiver end. In other words, the induced forward current strongly couples to the sky wave, receiving a parametric amplification from it, exhibiting a remarkably high gain and directivity, and is finally absorbed by a grounded load equal to the surge impedance without reflection at the receiver end. On the other hand, the induced backward wave on the wire travels in the opposite direction and is also absorbed by a grounded termination matched to the surge impedance without reflection. Therefore, no interaction occurs between the forward and backward waves. In addition, the antenna gain for a multiple N-wire antenna is increased as high as 20 $\log_{10}N$ dB, compared to a single wire. For instance, the gain is increased as high as 20 $\log_{10}3$=9.54 dB for a three-wire antenna.

Figure 2:
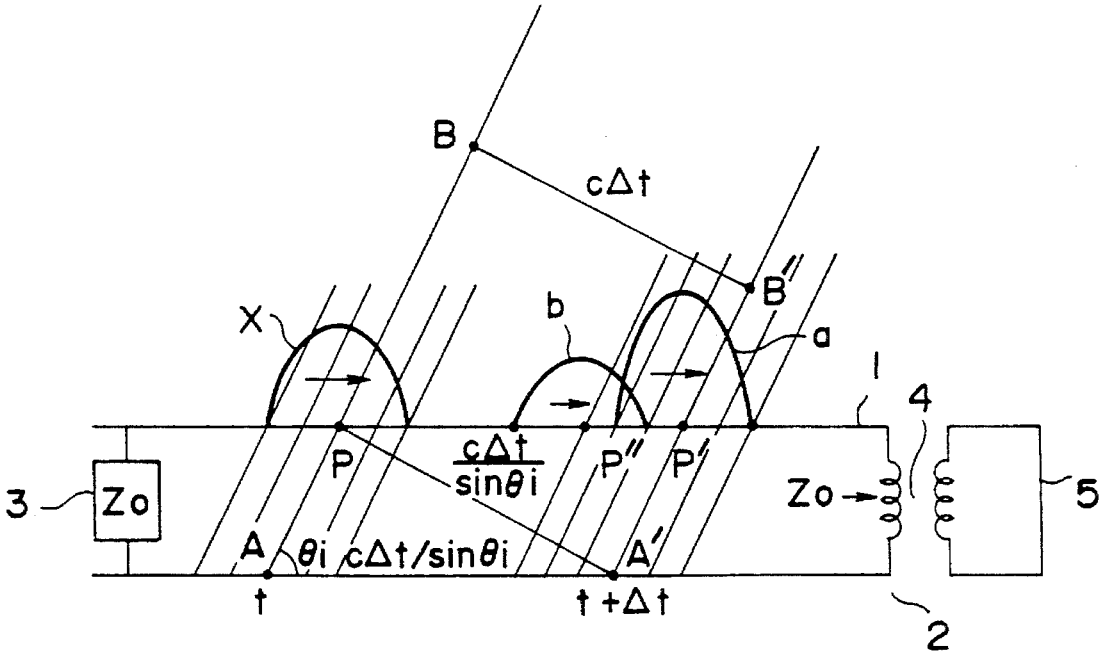
FIG. 2 illustrates schematically a parametric amplification due to strong coupling or resonance for the antenna of this invention and the attenuation due to weak coupling for the conventional wave antenna both between the incident sky wave and the induced line wave along the wire, comparatively.

FIG. 2 illustrates the relation between the incident sky wave and the induced line wave for the parametrically amplifying traveling-wave antenna and the conventional wave antenna. Suppose there is an incident signal sky wave whose wave front surface coincides with a plane AB at a time t. After the lapse of a time differential $\Delta t$, its front surface shifts to a plane A'B'. Then, the point A of intersection between the wave front and the ground surface moves along the surface by c $\Delta t/\sin\theta_i$. Accordingly, the apparent phase velocity of the incident wave in the horizontal direction becomes $c/\sin\theta_i$, being faster than the velocity of light (fast wave).

For the case of the parametrically amplifying traveling-wave antenna, the induced line wave X at the point P of intersection between the sky wave front and the wire 1, moves to the point P' after a time differential $\Delta t$, resulting in an apparent phase velocity equal to $c/\sin\theta_i$ (fast wave) that is also equal to the front velocity of the sky wave along the wire, but only when the angle of incidence of the sky wave is equal to a certain resonance angle near grazing incidence, explicitly defined later.

Namely, the induced line wave keeps following right along the sky wave, and its amplitude grows from X to the solid line a in FIG. 2 due to strong coupling between both waves, gaining energy and receiving parametric amplification from the sky wave.

For the conventional wave antenna, on the other hand, the phase velocity of the induced wave is less than the velocity of light (slow wave), only weakly coupling with the sky wave of horizontal or near horizontal incidence as described later in detail. As a result, the point P of intersection between the sky wave front and the induced current on the wire moves to the point P" in FIG. 2, representing a damped wave beyond a certain distance as mentioned above and as also shown by the dashed line b in FIG. 3.

Figure 3:
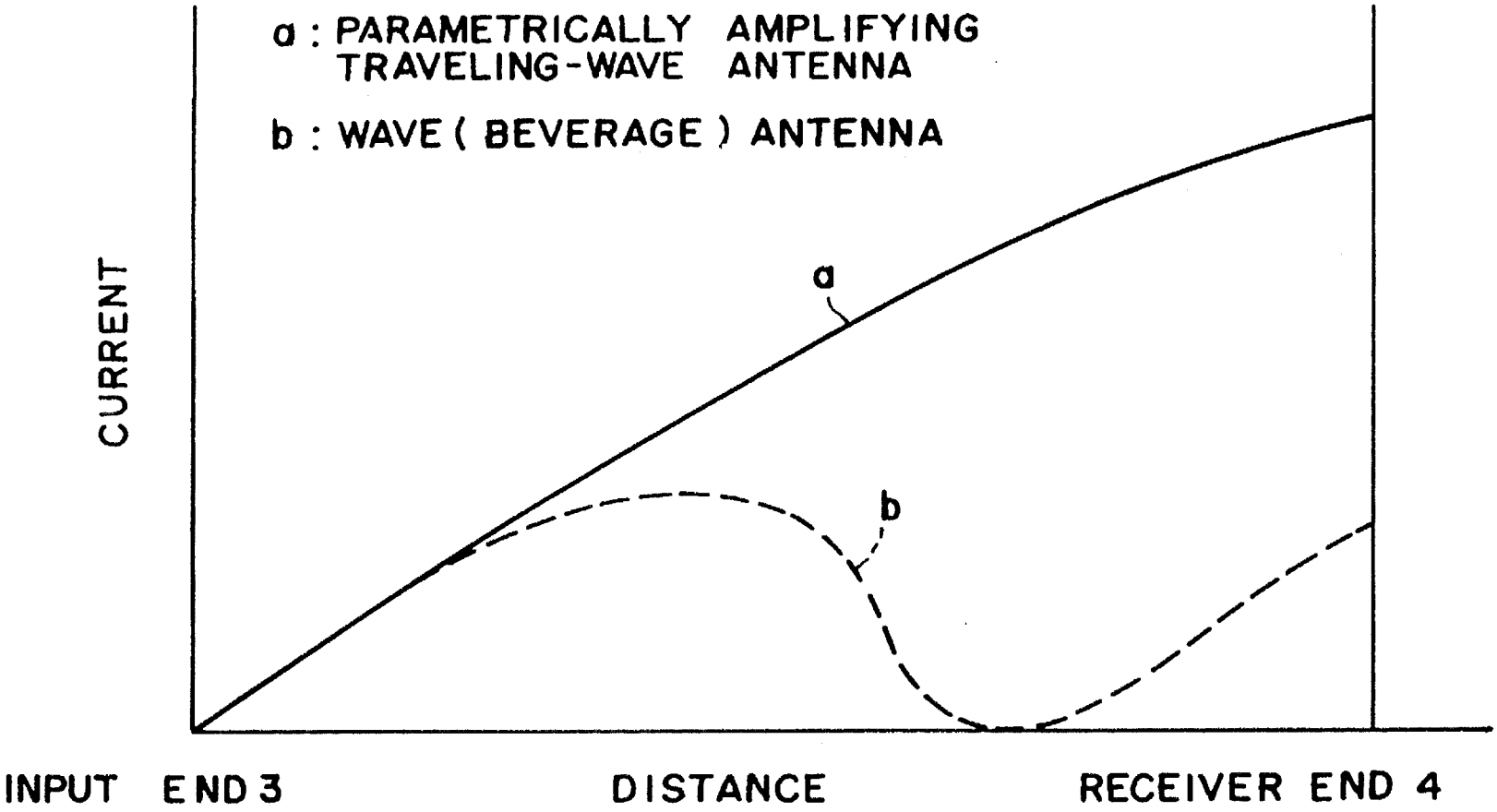
FIG. 3 shows a comparison of the antenna of the invention and the conventional wave antenna in the current distribution along the wire.

In this connection, FIG. 3 shows how the induced current changes along the wire for the present parametric antenna and for the conventional wave antenna. The current distribution (a) for the present antenna increases monotonically with distance, forming a growing wave by the parametric effect mentioned above, and becomes maximum at the receiver end, thus producing a remarkably high gain. This effect of parametric amplification is analogous to that of traveling-wave tubes; in place of electron beams, the sky wave plays a role in supplying the induced line current with energy, where the induced line current corresponds to the traveling wave along a helical circuit. However, an essential difference is that the incident sky wave plays two roles for the parametrically amplifying traveling-wave antenna. One is to induce the fast wave on the wire and the other is to amplify the induced line wave parametrically at the same time. In contrast, the electron beams for traveling-wave tubes play a role only in amplifying an external slow wave.

A mathematical theory of the parametrically amplifying traveling-wave antenna will be described below in close relation to its actual construction. Suppose the present antenna has a single conducting wire with a length of l and a height of h above a base-plate or ground, terminated by the surge impedance $Z_0$ at both ends as shown in FIG. 1, and with the z-axis parallel to the wire. When a plane sky wave is incident on the antenna, the current induced on the wire l(z) satisfies the following telegraphic equation with an external source as described in an article entitled "Active Distributed Parameter Lines with Ground Return" by H. Kikuchi in the Proceedings of the International Wroclaw Symposium on Electromagnetic Compatibility, 1984, pp. 153~162 [Ref.2]:

$$\frac{d^2I}{dz^2} - \Gamma^2 I = -YE^{(e)} \tag{1}$$

and its solution is given by $$I(z) = \frac{\tilde{E}^{(e)}(\theta_i)}{2Z_0}\left[-\frac{e^{-\Gamma z}\{1-e^{(\Gamma-jk_1 sin\theta_i)z}\}}{\Gamma - jk_1\sin\theta_i} + \frac{e^{-jk_1 z sin\theta_i}\{1-e^{-jk_1(l-z)sin\theta_i-\Gamma(l-z)}\}}{\Gamma + jk_1\sin\theta_i}\right] \tag{2}$$

where $j=\sqrt{-1}$, $\Gamma=\alpha+j\beta$ is the propagation constant of the line, $\alpha$ and $\beta$ is the attenuation and phase constants, respectively, $\theta_i$, is the angle of incidence, $k_1$ is the wave number in the medium 1, Y is the shunt admittance, and $E^{(e)}$ is the horizontal component of the total electric field of the incident and reflected waves in the plane of incidence which is written as $$E^{(e)}(z)=E_i\cos\theta_i e^{-jk_1 z sin\theta_i}(e^{jk_i h cos\theta_i} - Re^{-jk_1 h cos\theta_i})=\tilde{E}^{(e)}(\theta_i)e^{-jk_1 z sin\theta_i} \tag{3}$$

where $E^{(e)}$ is the electric field of the incident wave, h is the height of wire, and R is the reflection coefficient.

Then, the currents at the input and receiver ends, I(0) and I(l), and the antenna gain G are, respectively, expressed as $$I(o) = \frac{\tilde{E}^{(e)}(\theta_i)}{2Z_0}\cdot\frac{1-e^{-(\Gamma+jk_1 sin\theta_i)l}}{\Gamma + jk_1\sin\theta_i} \tag{4}$$

$$I(l) = \frac{\tilde{E}^{(e)}(\theta_i)}{2Z_0}\cdot\frac{\{1-e^{(\Gamma-jk_1 sin\theta_i)l}\}e^{-\Gamma l}}{\Gamma - jk_1\sin\theta_i} \tag{5}$$

$$G = 20\log_{10}\left|\frac{I(l)}{I(o)}\right|[dB] \tag{6}$$

Moreover, the gain is increased as much as $20\log_{10}N$ dB for the N-wire antenna.

We now obtain the propagation constant for two cases for weak coupling $\Gamma_0$ and for strong coupling $\Gamma$, corresponding to the conventional wave antenna and the present parametric antenna, respectively.

(i) $\Gamma \neq j\,k_1 \sin\theta_i$: case of weak coupling

The propagation constant of the induced wave along the wire is equal to that of the eigen-wave of the line; namely $\Gamma=\Gamma_0$, $\alpha=\alpha_0$, $\beta=\beta_0$, and the induced line wave couples only weakly to the incident sky wave. This is the case for the conventional wave antenna, and the induced line wave is a slow wave whose phase velocity is less than the velocity of light, namely $V_{P0}=\omega/\beta_0/\omega/k_1=c$ (: velocity of light in the medium 1).

(ii) $\Gamma \approx j\,k_1 \sin\theta_1$: case of strong coupling or resonance

Since $\Gamma - j\,k_1 \sin\theta_i = \alpha + j(\beta - k_1 \sin\theta_i) \approx 0$, we have $\beta \approx k_1 \sin\theta_i$ ($0<\theta_i<\pi/2$). So that the induced line wave becomes a fast wave with the phase velocity greater than the velocity of light. Then, we have the following relations for the phase velocity Vp and phase constant $\beta$ of the induced line wave, and for the current at the receiver end:

$$V_p = \frac{\omega}{\beta} \simeq \frac{\omega}{k_1\sin\theta_i} = \frac{c}{\sin\theta_i} = c\{1+\delta(\omega,\theta_i)\} \geq c \tag{7}$$

$$\beta = \frac{\omega}{c}(1-\delta) = k_1(1-\delta) \tag{8}$$

$$0 \leq \delta \simeq 1 - \sin\theta_i << 1,\ \sin\theta_i < 1,\ \theta_i \lesseqgtr \frac{\pi}{2} \tag{9}$$

$$I(l) \simeq \frac{\tilde{E}^{(e)}(\theta_i)}{2Z_0} l e^{-\Gamma l} \tag{10}$$

Based on these relations, we obtain all the line constants for the case of strong coupling or resonance from the equations of the distributed parameter line with distributed sources and the expression for the current distribution along the wire, referring to Eq. (15), page 158 in [Ref.2]:

$$-\frac{\partial V}{\partial z} = ZI - E^{(e)},\ -\frac{\partial I}{\partial z} = YV \tag{11}$$

$$\partial/\partial z = -\Gamma \tag{11a}$$

$$I(z) = -\frac{\Gamma_0/Z_0}{\Gamma^2 - \Gamma_0^2}E^{(e)}(z) \tag{12}$$

$$\Gamma_0 = \alpha_0 + j\beta_0 = \sqrt{ZY},\ Z_0 = \sqrt{Z/Y} \tag{12a}$$

$$Z = \frac{\omega\mu_1}{\pi}\left[\left(\frac{\delta_c}{4a} + P\right) + \frac{j}{2}\left\{\frac{\delta_c}{2a} + \ln\left(\frac{2h-a}{a}\right) + 2Q\right\}\right] \tag{12b}$$

$$Y = 2\pi\omega\epsilon_1\left[-\frac{2P'}{\left\{\ln\left(\frac{2h-a}{a}\right)\right\}} + 2\frac{j}{\left\{\ln\left(\frac{2h-a}{a}\right) + 2Q'\right\}}\right] \tag{12c}$$

where $\Gamma_0$ is the known propagation constant of the eigen-wave of the line as given in the articles entitled "Wave Propagation along Infinite Wire above Ground at High Frequencies" by H. Kikuchi in a periodical, Electrotech. J. Japan, Vol. 2, No. ¾, 1956, pp. 73~78 [Ref.3]. "Propagation Coefficient of the Beverage Aerial" by H. Kikuchi in a periodical, Proc. IEE, Vol. 120, No. 6, June, 1973, pp. 637~638 [Ref.4]: or "Power Line Transmission and Radiation" by H. Kikuchi in a book, "Power Line Radiation and Its Coupling to the Ionosphere and Magnetosphere" edited by H. Kikuchi, Readel, Dordrecht, 1983, pp. 59~80 [Ref.5 ].

From Egs. (10) and (12), the propagation constant of the induced line wave for strong coupling or resonance is determined as $$\alpha l \simeq -\frac{\beta_0}{\beta}(1-\alpha_0 l) \simeq -(1-\alpha_0 l) \simeq -1 < 0, \tag{13}$$

$$(|\alpha_0 l| << 1)$$

-continued $$\frac{\beta}{\beta_0} = 1 + \frac{(1/2) + \alpha_0 l}{1 + \beta_0^2 l^2} \simeq 1 + \epsilon \geq 1 \tag{14}$$

Now the attenuation constant of the induced line wave becomes negative, $\alpha<0$, being forced to change the sign of the attenuation constant of the eigen-wave of the line, $\alpha_0>0$ as a result of strong coupling or resonance. Accordingly, the induced line wave becomes a growing wave in contrast to a damped wave for the case of weak coupling.

Thus, the incident sky wave plays two roles in generating the induced line wave and in amplifying it parametrically. In contrast to such a catastrophic change from attenuation to amplification, the change in the phase constant or velocity is negligibly small. So that the induced line wave is still a fast wave, although its phase velocity becomes very slightly slower than that of the eigen-wave of the line, holding the following relations between the phase velocity of the induced line wave and that of the eigen-wave of the line:

$$\begin{aligned} V_{po} &= \frac{\omega}{\beta_0} \geq \frac{\omega}{\beta} = V_p \\ &= c(1+\delta) = \frac{\omega}{\beta_0}(1-\epsilon) = V_{po}(1-\epsilon) \\ &= c(1+\delta_0)(1-\epsilon) \geq c,\ (0 \leq \delta_0 << 1) \end{aligned} \tag{15}$$

Then, the resonance angle, $[\theta_1]_{Res}$, namely the angle of incidence leading to strong coupling or resonance, is given by $$\sin[\theta_i]_{Res} = 1-\delta = (1+\epsilon)(1-\delta_0) \simeq 1-\delta_0,\ (\delta_0 >> \epsilon) \tag{16}$$

or putting $\theta_i = (\pi/2) - \phi$ $$[\phi^2]_{Res} = \delta_0 - \epsilon \simeq \delta_0 (\delta_0 >> \epsilon) \tag{17}$$

On the other hand, the phase velocity of the eigen-wave of the line is written in the following form, as given in Eg. (21), page 66 in [Ref.5], from Eqs. (12a), (12b), (12c), and (15), taking into account [$\delta c/4a$, Q, Q', P, P']<ln [(2h–a)/a], retaining the first order of their Taylor's expansions, and taking the imaginary part of $\Gamma_0$:

$$\frac{V_{po}}{c} = 1 - \frac{(\delta_c/4a) + Q - Q'}{\ln\{(2h-a)/a\}} \tag{18}$$

where Q and Q' are written, from [Refs. 3, 4, 5], as $$Q - jP = \frac{1}{k_2^2 - k_1^2} \int_0^\infty \{u - \sqrt{u^2 - (k_2^2 - k_1^2)}\} e^{-(2h-a)u} du \tag{19}$$

$$Q' - jP' = \int_0^\infty \frac{e^{-(2h-a)u}}{\eta u + \sqrt{u^2 - (k_2^2 - k_1^2)}} du \tag{2}$$

where Re stands for the real part, $k_1^2 = \omega^2 \epsilon_1 \mu_1$, $k_2^2 = \omega^2 \epsilon_2 \mu_2 - j\omega\sigma_2\mu_2$, k is the wave number, $\sigma$, $\epsilon$, $\mu$are the conductivity, dielectric constant, and permeability, $\omega = 2\pi f$ is the angular frequency, $\eta = k_w^2/k_2^2$, h and a all the height and radius of wire, respectively, $\delta c = \sqrt{2/(\omega\sigma c\mu c)}$is the skin depth of wire, $\mu_1 = \mu_2 = \mu_0$, and the subscripts, 1 and 2 refer to the medium 1 (dielectric) and medium 2 (base-plate or ground), respectively. The functions Q and Q' are numerically obtained by using such tables or graphs prepared as seen in FIG. 3, page 70 in [Ref.5].

In order to determine the material to be used for the base-plate or ground for a certain range of frequencies, we choose such electrical properties, namely conductivity and dielectric constant as to satisfy the following resonance condition:

$$Q' - Q - \frac{\delta_c}{4a} > 0 \tag{21}$$

by using a set of tables or graphs prepared as mentioned above.

For instance, for a range of television frequencies around 100 MHz, the resonance condition (21) can be satisfied for $\sigma_2 = 10^{-1} \sim 1$ S/m and $\epsilon_2 = 2 \sim 5\ \epsilon_0$($\epsilon_0$: dielectric constant of air). So that the eigen-wave of the line becomes a fast wave. To predict the resonance angle for the use of such a base-plate, one first obtains Q and Q' by using a set of tables or graphs as mentioned above after choosing the radius and height of wire, for instance, to be a value of 2.5~0.5 mm and of 7.5 m~1 cm, respectively, for f=5 MHz~50 GHz for an air environment. By using these Q and Q', one calculates the phase velocity of the eigen-wave of the line from Eg. (18). Then, from Egs. (14) and (15), $\delta_0$ and $\epsilon$ are obtained, and finally the angle of strong coupling or resonance $[\theta_i]_{Res}$ is determined from Eq. (16). Thus the resonance angle can be predicted theoretically for given frequencies. In practice, however, one can make the inclination of base-plate variable and set it in such a direction as to obtain maximum reception experimentally.

In order to obtain such electrical constants, conductivity and dielectric constant for the base-plate or ground to be used for given frequencies as to satisfy the condition that the eigen-wave of the line is a fast wave whose phase velocity is higher than the velocity of light, one uses theoretical expressions, tables, and/or graphs prepared, based on [Refs.3–5].

As described above, the present antenna utilizes a parametric amplification due to strong coupling or resonance between the induced wave on the wire and the incident sky wave by lumping together and terminating both ends of a single wire or an array of wires with no reflection and by using a semiconductor or a lossy dielectric for the base-plate or ground whose electrical constants satisfy Eq. (21) for frequencies to be used. Therefore, when the incident sky wave reaches the antenna at a certain angle near the horizontal direction, an induced electromotive force on the wire gives rise to a current along the wire, and due to the effect of current return in the base-plate or ground, its traveling wave becomes a fast wave whose phase velocity is slightly higher than the velocity of light for a certain range of frequencies. Then, the phase velocity of the induced wave becomes equal to that of the induced sky wave in the horizontal direction, causing strong coupling or resonance between both waves. Thus, the current in the wire is amplified by parametric action of the incident sky wave, and becomes a maximum at the receiver end 4, producing a remarkably high gain.

Thus, by making its resonance angle coincide with the angle of incidence, the present antenna offers a gain much higher than that of the conventional receiving antenna such as for television or satellite broadcasting. Then, the base-plate or ground plays a role in deriving parametric amplification of the induced line wave from the incident sky wave.

In addition, mass production of the material of the base-plate or ground for given frequencies can be easy by establishing a manufacturing process of a semiconductor or a lossy dielectric with prescribed electrical constants for the material such as a kind of concrete.

In the above-described embodiments, a prescribed semiconductor or lossy dielectric is employed as the ground return of a single wire or a multi-wire array. The present invention can also be applied to a spacecraft antenna by sticking a thin membrane of the material on the surface of the spacecraft or aircraft, thus obtaining sharp directivity in a flying direction.

Figure 4:
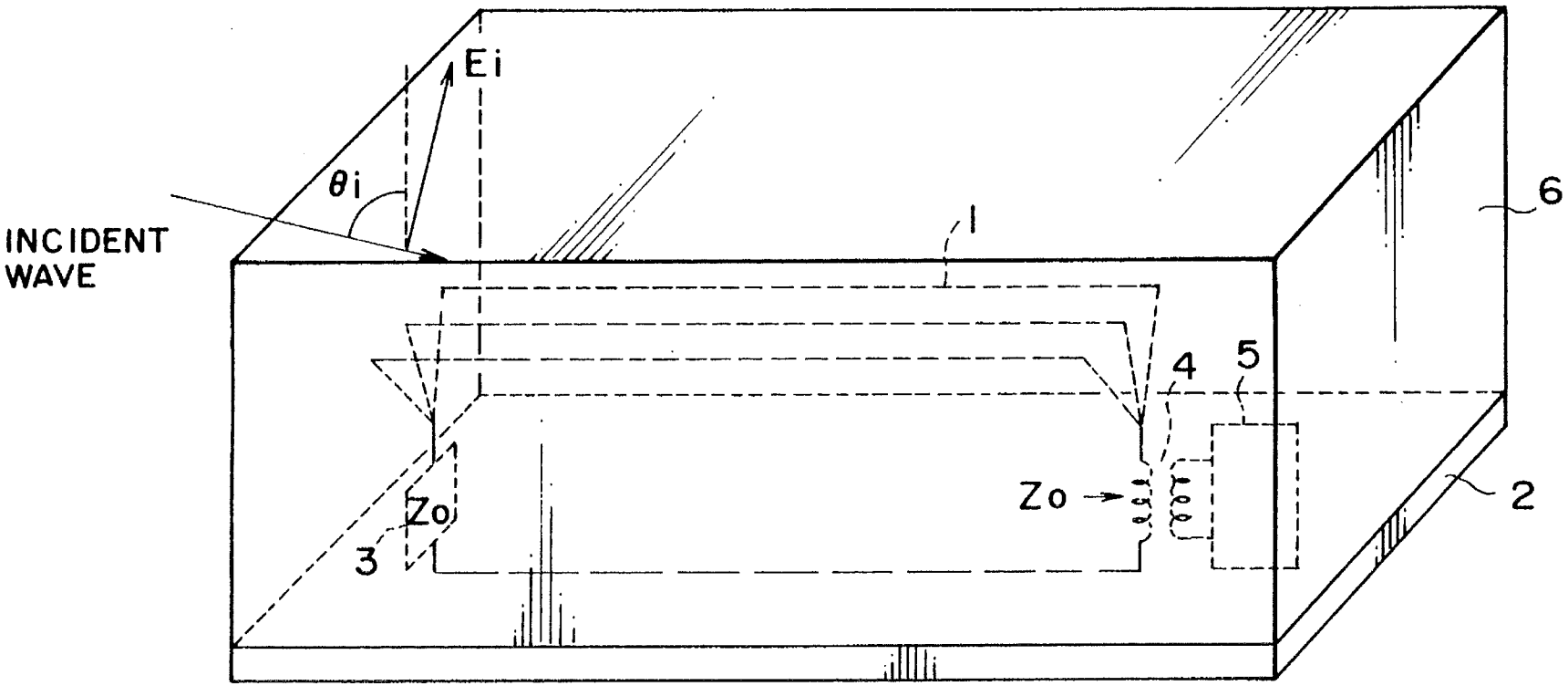
FIG. 4 is a schematic diagram of another embodiment based on the present invention where the above wire-conductor is buried in a dielectric with a high dielectric constant placed on a base-plate.
Figure 5:
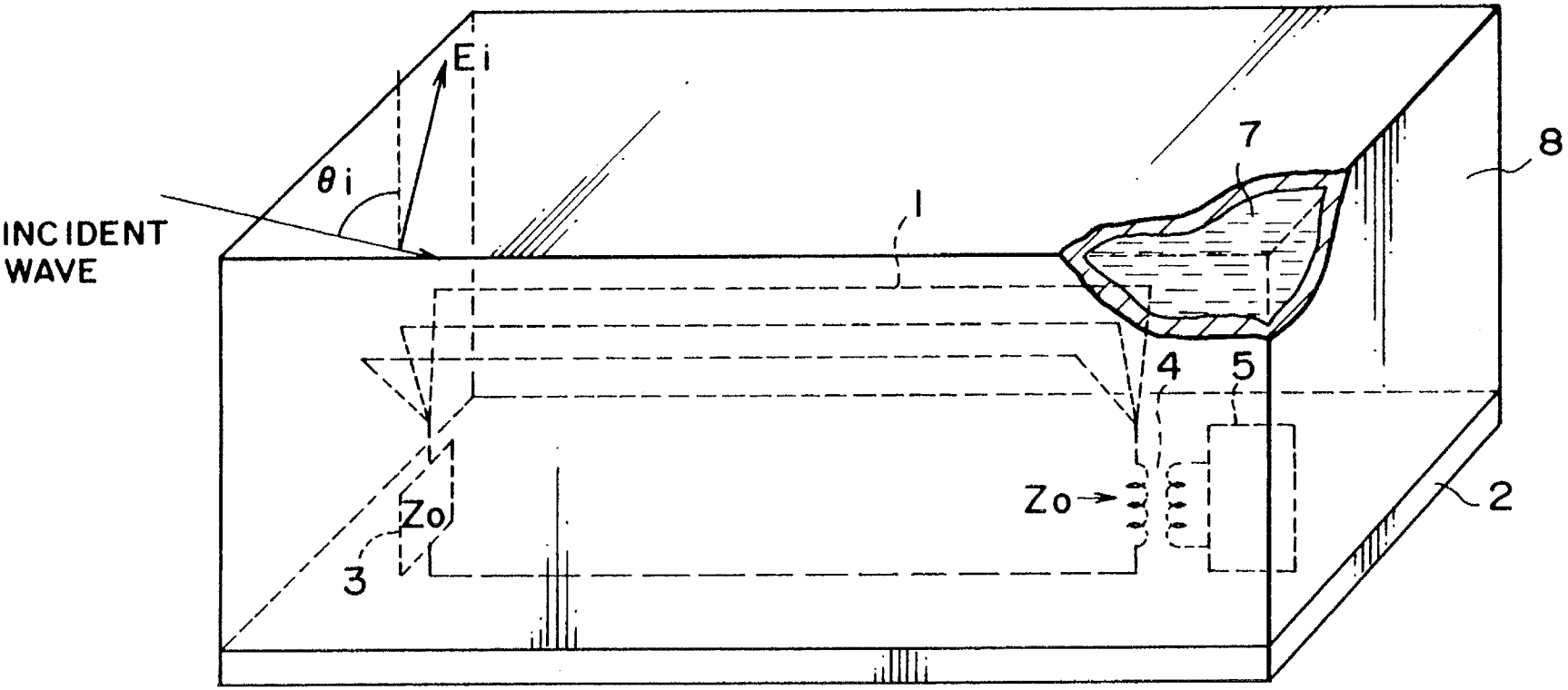
FIG. 5 is a schematic diagram of another embodiment based on the present invention where the antenna is set up within a box with thin dielectric walls filled with an insulating oil of high dielectric constant and low conductivity, the base-plate and wire-conductor of the antenna being immersed in the oil.
Figure 6:
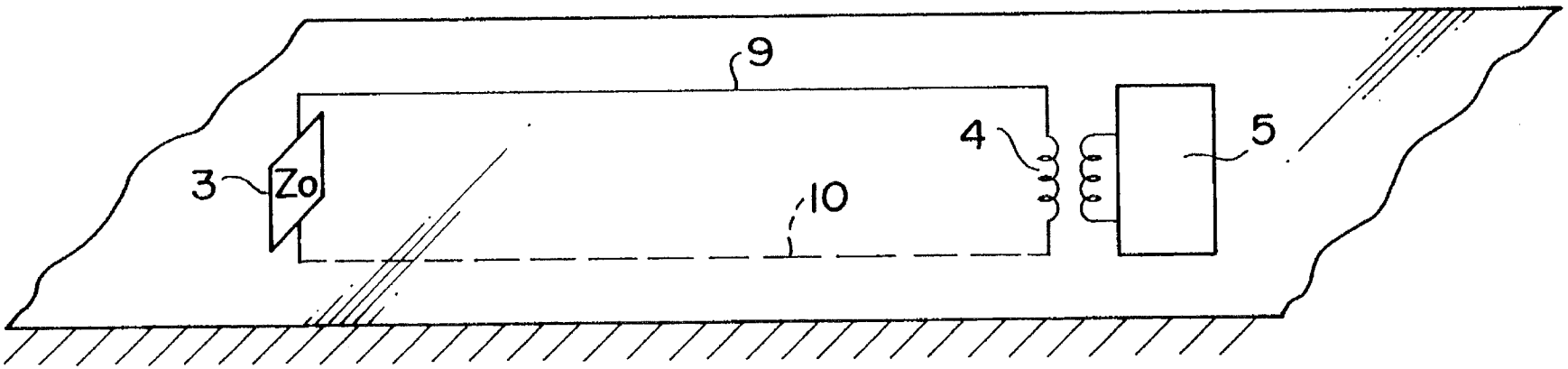
FIG. 6 (PRIOR ART)
FIG. 6 is a schematic diagram of the construction of a conventional wave antenna.

In order to miniaturize the above-described antenna system for given frequencies or to use it for lower frequencies, a similarity law can be applied to a dielectric medium with a refractive index n where the wavelength is reduced to 1/n. In practice, this can be done by burying the above-described antenna in a dielectric is with high dielectric constant placed on a base-plate as shown in FIG. 4. For example, in a dielectric environment where the specific dielectric constant is as high as 100, the antenna dimension can be reduced to 1/10 that in an air environment. A similar miniaturization can be performed by setting the antenna within a volume having thin dielectric walls 8 and filling the volume with an insulating oil 7 of high dielectric constant and low conductivity. The base-plate and wire conductor are immersed in the oil as shown in FIG. 5.

The present invention can also be applied to a natural ground instead of an artificial base-plate as in the conventional wave antenna. Then, the range of the resonance frequencies for strong coupling is lowered usually to a range of 1~100 MHz, depending on the electrical constants, conductivity and dielectric constant of the earth, from a range of ultrashort waves or microwaves for base-plate return of the above-described embodiment. Thus, the range of frequencies to be used for earth return is much higher than that for the conventional wave antenna below 100 KHz or so.

The present invention can also be applied to an ocean return in place of natural ground return described above. Then, the range of frequencies to be used is increased up to a range of 10~500 MHz. In practice, the present antenna can be installed on ships or vessels.

As described above, the present invention can be applied to a wide range of frequencies for intermediate length waves, short waves, ultrashort waves, and microwaves but not for a range of long wavelengths below 100 KHz as in the conventional wave antenna with less gain, by utilizing not only a natural ground for the current return but also a prescribed semiconductor or lossy dielectric base-plate with dimensions and electrical constants suitable for the required frequencies and purposes. Thus, depending on the frequencies to be used, a return circuit is chosen to be a natural earth for intermediate length waves, short waves, and ultrashort waves, an ocean for short and ultrashort waves, and a prescribed semiconductor or lossy dielectric base-plate for ultrashort waves and microwaves.

The above-described embodiments are to be used mainly as a receiving antenna for television and satellite broadcasting, radar, or international communications, but the present invention can also be applied or commonly used as a highly directive transmitting antenna or radar. In that case, a transmitter or signal generator is connected to a transmitter end, while the radiation end has to be open.

Thus, the present invention is concerned with parametrically amplifying traveling-wave antennas by means of strong coupling or resonance between the induced line wave, and the incident sky wave, and can be applied over a wide range of frequencies to almost all kinds of radio communications, particularly to television and satellite broadcasting, radar, international communications, ship communication, and over-the-horizon communication, constituting a high gain and highly directive receiving system.

What is claimed is:

1. A parametrically amplifying traveling-wave antenna utilizing parametric amplification through strong coupling or resonance between an induced line wave and an incident sky wave comprising:

base-plate means having electrical constants satisfying the following resonance condition:

$$Q' - Q - \frac{\delta_c}{4a} > 0$$

where $$Q = Re\,\frac{1}{k_2^2 - k_1^2}\int_0^\infty \{u - \sqrt{u^2 - (k_2^2 - k_1^2)}\}\,e^{-(2h-a)u}\,du$$

$$Q' = Re\int_0^\infty \frac{e^{-(2h-a)u}}{\eta u + \sqrt{u^2 - (k_2^2 - k_1^2)}}\,du$$

and Q and Q' are extended Carson's functions including corrections arising from finite earth conductivity and permitivity, u is an integral variable in a Fourier representation of the correction functions, Re stands for the real part, $k_1^2=\omega^2\epsilon_1\mu_1$, $k_2^2=\omega^2\epsilon_2\mu_2-j\omega\sigma_2\mu_2$, k is the wave number, $\sigma$, $\epsilon$, and $\mu$ are, respectively, conductivity, dielectric constant, and permeability, $\omega=2\pi f$ is the angular frequency, $[\eta^2]$ $\eta=k_2^2/k_1^2$, h and a are, respectively, the height and radius of a wire conductor, $\delta_c=\sqrt{2/(\omega\sigma_c\mu_c)}$ is skin depth of the wire conductor, $\mu_1=\mu_2=\mu_0$, where $\mu_0$ is vacuum permeability, and where subscripts c, 1, and 2 refer to the wire conductor, a dielectric medium 1, and the base-plate means or ground medium 2, the wire conductor having ends and being disposed above the base-plate means or ground, the ends being terminated so that no signal reflections are produced at the ends.

2. The antenna according to claim 1 wherein the base-plate means is a semiconductor base-plate.

3. The antenna according to claim 1 wherein the base-plate means is a lossy dielectric base-plate.

4. The antenna according to claim 1 wherein the base-plate means is a thin membrane attached to an aircraft.

5. The antenna according to claim 1 wherein the base-plate means is the earth.

6. The antenna according to claim 1 wherein the base-plate means is an ocean.

7. The antenna according to claim 1 wherein the conductor is a single wire.

8. The antenna according to claim 1 wherein the conductor is an array of wires.

9. The antenna according to claim 1 wherein the wire conductor is copper.

10. The antenna according to claim 1 comprising a solid dielectric with a high dielectric constant on the base-plate means wherein the wire conductor is disposed within the solid dielectric.

11. The antenna according to claim 1 comprising a volume bounded by thin dielectric walls having low conductivity and filled with oil wherein the base-plate means and wire conductor are disposed within the oil.

* * * * *